United States Patent [19]

Toya

[11] Patent Number: 4,727,729

[45] Date of Patent: Mar. 1, 1988

[54] ICE MAKING COMPARTMENT IN AN ICE MAKER

[75] Inventor: Ko Toya, Shimane, Japan

[73] Assignee: Hoshizaki Electric Co., Ltd., Toyoake, Japan

[21] Appl. No.: 455,897

[22] Filed: Jan. 5, 1983

[30] Foreign Application Priority Data

Jan. 20, 1982 [JP] Japan ..... 57-4996[U]

[51] Int. Cl.[4] ..... F25C 1/12

[52] U.S. Cl. ..... 62/347

[58] Field of Search ..... 62/347, 348, 352

[56] References Cited

U.S. PATENT DOCUMENTS

| | | | |
|---|---|---|---|
| 3,003,335 | 10/1961 | Kattis | 62/348 |
| 3,430,452 | 3/1969 | Dedricks | 62/347 |
| 3,913,349 | 10/1975 | Johnson | 62/352 |
| 4,366,679 | 1/1983 | Van Steenburgh, Jr. | 62/352 |

FOREIGN PATENT DOCUMENTS

| | | |
|---|---|---|
| 46-3232 | 1/1971 | Japan . |
| 44418 | 9/1967 | United Kingdom . |

*Primary Examiner*—William E. Tapolcai

*Attorney, Agent, or Firm*—Wenderoth, Lind & Ponack

[57] ABSTRACT

An ice making compartment in an ice maker comprises a vertical ice making plate where cooling pipes are fixed to the rear surface of the ice making plate, and a plurality of longitudinal and transversal partition plates fixed to the front surface of the ice making plate and defining the cells in cooperation with the ice making plate. Both partition plates comprise plates having different heights from the front surface of the ice making plate so as to separate certainly the adjoining ice cubes during the defrosting cycle. It is desirable that at least one of the transversal partition plates end tip is sharper than the others thereof.

5 Claims, 8 Drawing Figures

ICE MAKING COMPARTMENT IN AN ICE MAKER

BACKGROUND OF THE INVENTION

The present invention relates to an ice making compartment in an ice maker making use of a falling water circulating system.

An ice making compartment 1 in an ice maker using the conventional system is illustrated in FIG. 1. The compartment 1 is made of a very thermally conductive metal. The compartment 1 comprises an ice making flat plate 2 forming the rear portion of the compartment, and a plurality of longitudinal partition plates (not shown) and transversal partition plates 3 fixed on said ice making plate 2 and defining cells 6 in cooperation with the plate 2. A cooling pipe 4 is fixed to the rear surface of the ice making plate 2 to cool the compartment 1. The holes of a spraying pipe 5 above the compartment 1 are disposed to spray the water for ice making. As shown in FIG. 1, the transversal partition plates 3 are inclined downward so that during the defrosting cycle the manufactured ice cubes from compartment 1 will fall naturally.

However, in the above conventional compartment, as shown in FIG. 2, each connecting part *7a* joining together the ice cubes formed within the cells becomes thick as the ice grows during the ice making cycle. Therefore, there occurs a case in which adjoining ice cubes are not fully separated when the ice 7 falls into an ice storage hopper during the defrosting cycle. In this case, there is a disadvantage in that a user must separate the adjoining ice cubes, which is a troublesome operation. In particular, when the quantity of the ice stored within the hopper increases, the above disadvantage becomes severe since the falling distance decreases thereby reducing the impact of the ice. Furthermore, the capacity of the ice storage hopper cannot be effectively utilized when the adjoining ice cubes are not separated.

SUMMARY OF THE INVENTION

The ice making compartment, according to the present invention, comprises a vertical ice making plate where cooling pipes are fixed to the rear surface of the ice making plate, and a plurality of longitudinal and transversal partition plates fixed to the front surface of the ice making plate and defining cells in cooperation with the ice making plate. Both partition plates comprise plates having differing heights from the front surface of the ice making plate. It is preferable that the end tip at least one of said transversal partition plates is sharper than the others. The transversal and longitudinal partition plates advantageously comprise alternatively arranged higher and lower plates from the front surface of the ice making plate. Each end tip of the higher transversal plates advantageously has a roundness ranging from about 0.2 to 1.0 mm. It is desirable that the higher and lower transversal plates are respectively identical to the higher and lower longitudinal plates in height from the front surface of the ice making plate, and that the difference in height between the higher and lower partition plates is about 3 to 5 mm.

It is a principal object of the present invention to provide a compartment which certainly separates the adjoining ice cubes during the defrosting cycle.

Other objects and advantages of the present invention will become apparent from the following detailed description, taken in conjunction with the accompanying drawings.

DESCRIPTION OF THE PREFERRED EMBODIMENTS

Figure 1:
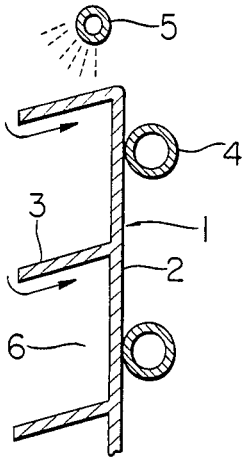
FIG. 1 PRIOR ART
FIG. 1. is an enlarged longitudinal sectional view of the conventional ice making compartment.
Figure 2:
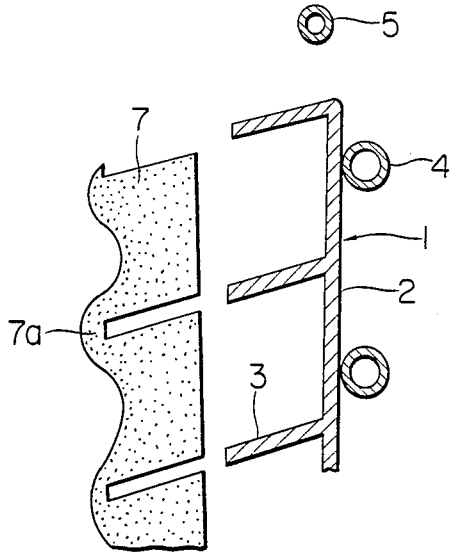
FIG. 2 PRIOR ART
FIG. 2 is an enlarged longitudinal sectional view showing a condition in which the defrosting has been performed in the compartment in FIG. 1.
Figure 3:
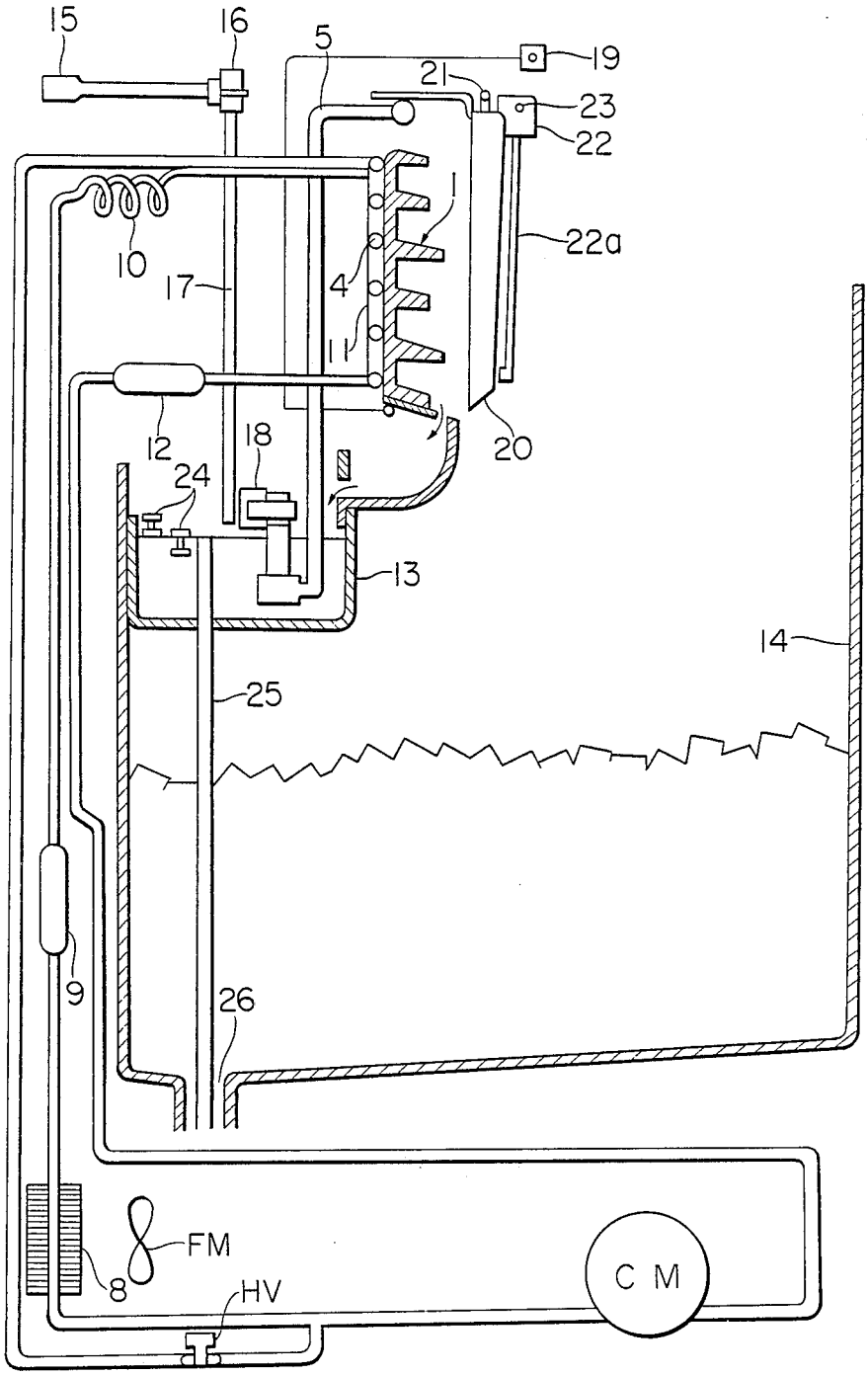
FIG. 3 is an arranged view of an ice maker containing an ice making compartment according to the present invention.

Referring to FIG. 3 of the drawings, an arrangement of an ice maker containing a compartment according to the present invention is illustrated where the reference numbers are the same as the ones in FIGS. 1 and 2 for identical elements. The cooling pipe 4 for cooling the ice making compartment 1 is fixed to the rear surface of the compartment 1 which is longitudinally disposed. The cooling pipe 4 is contained in an evaporator 11. A closed refrigerant circuit is formed by the evaporator 11, a compressor CM compressing the refrigerant, a condenser 8 with a fan motor FM condensing the refrigerant, a dryer 9, a capillary tube 10 and an accumulator 12. The compartment 1 is cooled by the action of the closed refrigerant circuit during the ice making cycle. Alternatively, during the defrosting cycle, the refrigerant gas with high temperature and high pressure from the compressor CM flows into the cooling pipe 4 of the evaporator 11 by opening a hot gas valve HV thereby to warm the compartment 1.

The holes of the spraying pipe 5 above the compartment 1 are disposed to spray the water onto the uppermost portion of the compartment 1. A water tank 13 is disposed below the compartment 1 to store the water for ice making. One side wall of the tank 13 is attached to the inner wall of a side of an ice storage hopper 14. The water for ice making within the tank 13 is supplied into the spraying pipe 5 by a motor 18 disposed within the tank. Water is supplied to the tank through a water supplying port 15 communicated with a tap and a water supplying tube 17 with a valve 16.

The completion of the defrosting in the compartment 1 is detected by a defrosting thermostat 19, while on the other hand, the completion of the ice making is detected by a known means such as a device for detecting ice growth. A rotatable cover 20 disposed on the front side of the compartment 1 is spaced a predetermined distance from the compartment and rotatably supported by a shaft 21. A detecting bar 22a on the right side of the cover 20 is rotatably supported by a shaft 23 to rotate said bar together with the rotation of the cover 20 and to detect when the hopper is full of ice. A storage switch 22 in the upper end of the detecting bar 22*a* is provided to detect when the hopper is full of ice by the rotating action of the detecting bar. In addition, numbers 24, 25 and 26 respectively designate a float switch for detecting the water level within the tank, an overflow pipe and a drain port for discharging the melted water within the hopper.

Figure 4:
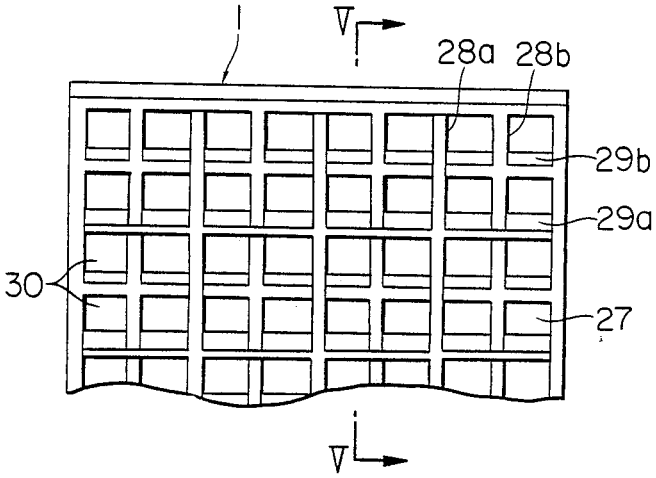
FIG. 4 is a partially broken enlarged plan view of the ice making compartment in FIG. 3.
Figure 5:
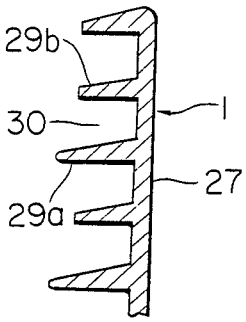
FIG. 5 is an enlarged longitudinal sectional view taken along line V—V in FIG. 4.

Referring to FIG. 4, the ice making compartment 1 is made of a very thermally conductive metal such as copper. The compartment 1 is composed of a flat ice making plate 27 forming the rear portion thereof, and a plurality of longitudinal and transversal partition plates 28 and 29 respectively fixed on the ice making plate 27. The cells 30 are defined by the plates 27, 28 and 29. As shown in FIG. 5, the transversal partition plates 29 are composed of higher transversal partition plates 29*a* being the higher plates to the ice making plate 27 and lower transversal partition plates 29*b* being the lower plates. The higher and lower transversal partition plates 29*a* and 29*b* are alternatively arranged and fixed on the ice making plate 27. However, the higher plates 29*a* may be arranged in the lower plates 29*b* at arbitrary intervals and the lower plates 29*b* may also be arranged in the higher plates 29*a* at arbitrary, intervals. The difference in height between the higher plates 29*a* and the lower plates 29*b* is about 3–5 mm in the present embodiment. The rounded end tips of the higher plates 29*a* are sharper than the rounded ones of the lower plates 29*b*. (However, each end tip of the lower plates may be sharpened as well as the tips of the higher plates.) Alternatively, the longitudinal partition plates 28 are flat plates at a uniform thickness (which are preferably thin) and are composed of higher and lower longitudinal partition plates 28*a* and 28*b* respectively disposed alternatively as well as the transversal partition plates 29. The higher plates 28*a* and 29*a* of their respective longitudinal and transversal partition plates 28 and 29 are both the same height from the ice making plate 27. Similarly, the lower longitudinal and transversal partition plates 28*b* and 29*b* are both the same height from the ice making plate 27.

The action of the ice making compartment according to the present invention will now be explained.

In the ice making operation, the water for ice making contained in the tank 13 is sprayed by the motor 18 through the spraying pipe 5 onto the uppermost transversal partition plate 29 of the ice making compartment 1. The compartment 1 is cooled by the cooling pipe 4 during the time of ice making. Accordingly, the water flowing into the cells 30 from the uppermost transversal partition plate is changed into ice, and the unfrozen water enters into the tank 13 along the lower end of the compartment 1 and is again sprayed by the motor 18 through the spraying pipe 5 to the compartment.

Figure 6:
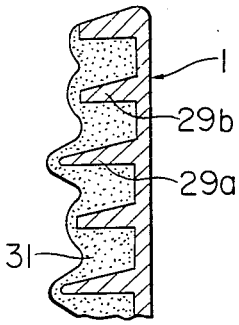
FIG. 6 is an enlarged longitudinal sectional view showing a condition of the compartment in FIG. 5 when the ice making cycle has been completed.

The ice is thus formed within the cells 30 and as shown in FIG. 6, the water passing between the cells is simultaneously frozen at the end tips of the higher and lower transversal partition plates 29*a* and 39*b* respectively. However, since the higher transversal plates 29*a* are higher than the lower plates 29*b* in height of the end tip from the ice making plate 27, the freezing is not easily performed at the end tips of the higher plates 29*a* so that the ice formed at the end tip of each higher plate 29*a* is thinner than the ice formed at the end tip of each lower plate 29*b*. A similar result occurs in the case of the higher and lower longitudinal partition plates 28*a* and 28*b* respectively.

Figure 7:
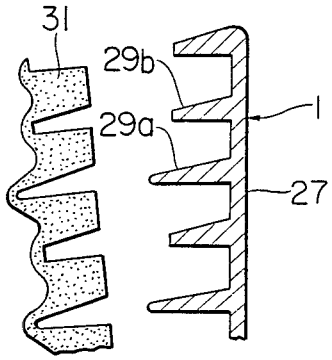
FIG. 7 is an enlarged longitudinal sectional view showing a condition of the compartment in FIG. 5 when the defrosting cycle has been completed.

When ice making has been completed, it is detected by a known detecting means and the ice making operation stops. Then, the defrosting operation starts and the hot gas flows into the cooling pipe 4 to warm the compartment 1. Hence, as shown in FIG. 7, the ice 31 formed in the compartment falls therefrom and hits the cover 20 thereby rotating the cover 20 and the detecting bar 22*a* in the counterclockwise direction in FIG. 3. Thus the ice 31 is stored in the hopper 14. When the ice 31 falling from the compartment 1 hits on the hopper inner walls or the stored ice within the hopper, the ice connecting parts corresponding to the higher partition plates will certainly crack first and the ice connecting parts corresponding to the lower partition plates will crack next, since as stated above, the ice formed at each end tip of the higher plates 28*a* and 29*a* is thinner than the ice formed at each end tip of the lower plates 28*b* and 29*b*. Even when the ice connecting parts corresponding to lower plates does not crack due to weak impact forces on the ice 31, the ice cubes are separated within a short time by the melting of the connecting parts.

Figure 8:
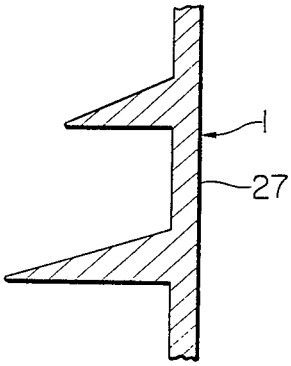
FIG. 8 is a partially broken enlarged longitudinal sectional view showing another compartment according to the present invention.

FIG. 8 shows another embodiment of the compartment where the end tips of said transversal partition plates are even sharper in comparison to the end tips thereof in FIGS. 4–7. Furthermore, the end tip of each transversal partition plate has a slight roundness (R) for smooth downward water flow. The range of R is about 0.2–1.0 mm and preferably near 0.3 mm. When the compartment in FIG. 8 is used, the ice formed at said end tip with R is even thinner and more easily cracked than the ice formed at each end tip of the partition plates in FIGS. 4–7.

It is easily understood from the above that the longitudinal and transversal partition plates 28 and 29 may respectively comprise a plurality of partition plates having different heights from the ice making plate if desired.

As stated above, the compartment according to the present invention comprises transversal and longitudinal partition plates having higher and lower plates from the ice making plate so that the ice formed at the end tip of the higher plate is thinner than the ice formed at the end tip of the lower plate. Accordingly, the joining ice cubes can be certainly separated during the defrosting cycle and the stored ice quantity per unit volume within the ice storage hopper increases. Thus, the stored ice quantity within the hopper increases on the whole and the hopper capacity can be more effectively utilized.

Although the difference between the higher partition plates and the lower partition plates is about 3–5 mm in the above embodiment, it may be suitably changed according to conditions. Higher or lower partition plates may be partially disposed on the ice making plate as desired or instead of this an alternate arrangement may be suitably employed.

What is claimed is:

1. In an ice making compartment for an ice making apparatus which compartment comprises a vertical ice making plate in which a cooling pipe is fixed to the rear surface of the ice making plate, and a plurality of longitudinal and transversal partition plates are fixed to the front surface of the ice making plate, thus defining cells in cooperation with the ice making plate, the improvement wherein both said partition plates comprise plates having different heights from the front surface of the ice making plate.

2. An ice making compartment as claimed in claim 1, wherein the end tip of at least one of said transversal partition plates is sharper than the others thereof.

3. An ice making compartment as claimed in claim 1, wherein each end tip of the higher transversal plates has a roundness in the range of about 0.2 to 1.0 mm.

4. An ice making compartment as claimed in claim 1, wherein the higher and lower transversal plates are respectively identical to the higher and lower longitudinal plates in height from the front surface of the ice making plate.

5. An ice making compardment as claimed in claim 4, wherein the difference in height between the higher and lower partition plates is about 3 to 5 mm.

* * * * *